US006963023B2

(12) United States Patent
Hsieh

(10) Patent No.: US 6,963,023 B2
(45) Date of Patent: Nov. 8, 2005

(54) RETAINING DEVICE FOR A DRUM

(76) Inventor: Wu-Hong Hsieh, No. 162, Chung Shan 2dn Rd., Lu Chou City, Taipei Hsien (TW)

( * ) Notice: Subject to any disclaimer, the term of this patent is extended or adjusted under 35 U.S.C. 154(b) by 53 days.

(21) Appl. No.: 10/714,029

(22) Filed: Nov. 14, 2003

(65) Prior Publication Data

US 2005/0103184 A1 May 19, 2005

(51) Int. Cl.[7] ..... G10D 13/02

(52) U.S. Cl. ..... 84/421

(58) Field of Search ..... 84/421, 327, 329; 248/443

(56) References Cited

U.S. PATENT DOCUMENTS 6,710,236 B2 * 3/2004 Takegawa ..... 84/421

* cited by examiner

*Primary Examiner*—Kimberly Lockett
(74) *Attorney, Agent, or Firm*—Dellett & Walters

(57) ABSTRACT

A retaining device includes a top clamping seat having arms divergently extending out of the top clamping seat and each arm provided with a claw adjustably connected to the arm, a bottom seat having linkages pivotally extending upward to pivotally connect to mediate portions of the arms, and an adjusting ring adapted to be threadingly connected to the drum stand to abut a side face of the bottom seat to cause the bottom seat to move. Movement of the bottom seat is able to initiate movement of the top clamping seat and thus the claws are able to clamp a drum seated on the drum stand and the adjustability of the claws relative to the arms allows the retaining device to clamp drums of different sizes.

6 Claims, 6 Drawing Sheets

RETAINING DEVICE FOR A DRUM

BACKGROUND OF THE INVENTION

1. Field of the Invention

The present invention relates to a retaining device, and more particularly to a retaining device for drums of different dimensions. With the retaining device, drums of varied sizes are able to be retained.

2. Description of Related Art

With reference to FIG. 7, a conventional retaining device (51) to secure a drum (in phantom line) is mounted on a drum stand (50) and has a top clamping seat (510) securely mounted on a distal end of the drum stand (50) and a bottom seat (511) slidably mounted on the drum stand (50). The top clamping seat (510) has claws (512) divergently extending out of the top clamping seat (510) and each claw (512) having a bent (not numbered) formed a distal end of a corresponding one of the claws (512). The bottom seat (511) has ribs (513) pivotally extending out to engage with a mediate portion of a corresponding one of the claws (512). An adjusting ring (52) is threadingly movable relative to the drum stand (50).

When the retaining device (51) on the drum stand (50) is about to be used to clamp a drum, the operator is able to rotate the adjusting ring (52) upward relative to the drum stand (50) such that the claws (512) are gradually leaned toward the drum seated on the retaining device (51). Consequently, the drum is secured on top of the drum stand (50). However, the retaining device can only retain a drum of a certain dimension. For drums having dimensions greater or smaller than the range of the claws (512), the retaining device will be too small to retain the drums.

To overcome the shortcomings, the present invention tends to provide an improved retaining device to mitigate the aforementioned problems.

SUMMARY OF THE INVENTION

The primary objective of the present invention is to provide an improved retaining device having claws adjustably connected to the arms of the retaining device such that the retaining device is able to cope with drums of different dimensions.

To accomplish the foregoing objective, the retaining device of the present invention has arms extending out from a top clamping seat and claws each adjustably connected to a corresponding one of the arms so that when dimension adjustment is required, the operator is able to relocate the claws to deal with drums of different dimensions.

Other objects, advantages and novel features of the invention will become more apparent from the following detailed description when taken in conjunction with the accompanying drawings.

DETAILED DESCRIPTION OF THE PREFERRED EMBODIMENT

Figure 1:
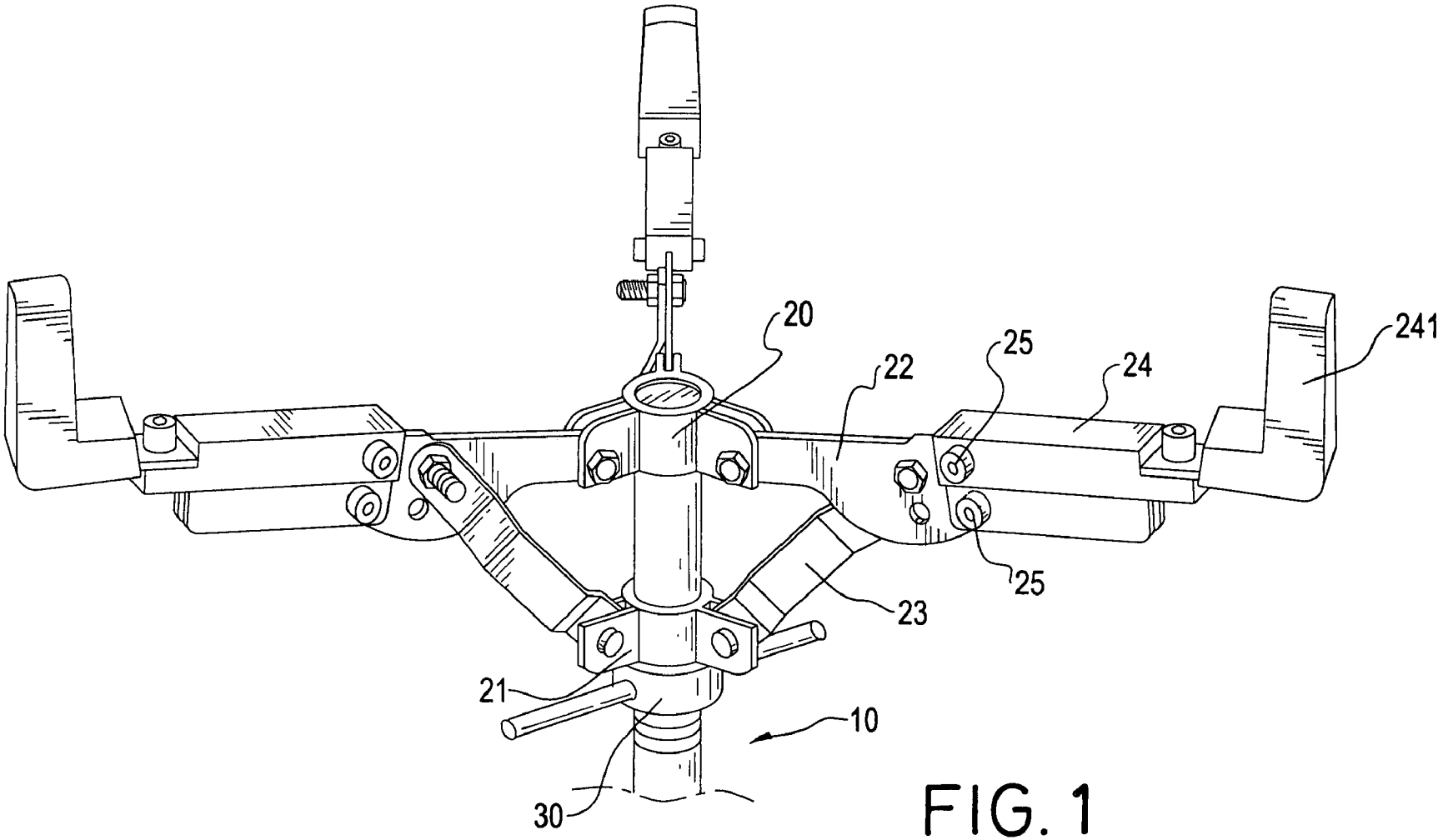
FIG. 1 is an exploded perspective view of the present invention.

With reference to FIG. 1, the retaining device in accordance with the present invention is adapted to combine with a drum stand (10) and has a top clamping seat (20) securely mounted on a distal end of the drum stand (10) and having arms (22) divergently extending out of the clamping seat (20) and each arm (22) provided with a claw (24), a bottom seat (21) slidably mounted on the drum stand (10) and having linkages (23) pivotally extending upward to pivotally connect to mediate portions of the arms (22). An adjusting ring (30) is threadingly connected to the drum stand (10) to abut a side face of the bottom seat (21). Therefore, when the adjusting ring (30) is rotated to push the bottom seat (21) upward (or downward) relative to the drum stand (10), the upward (downward) movement of the bottom seat (21) forces the claws (24) to clamp (release) a drum (not shown) seated on top of the retaining device of the present invention. However, because the clamping operation of the claws (24) to the drum is the same as that disclosed in the background, detailed description thereof is omitted.

Figure 2:
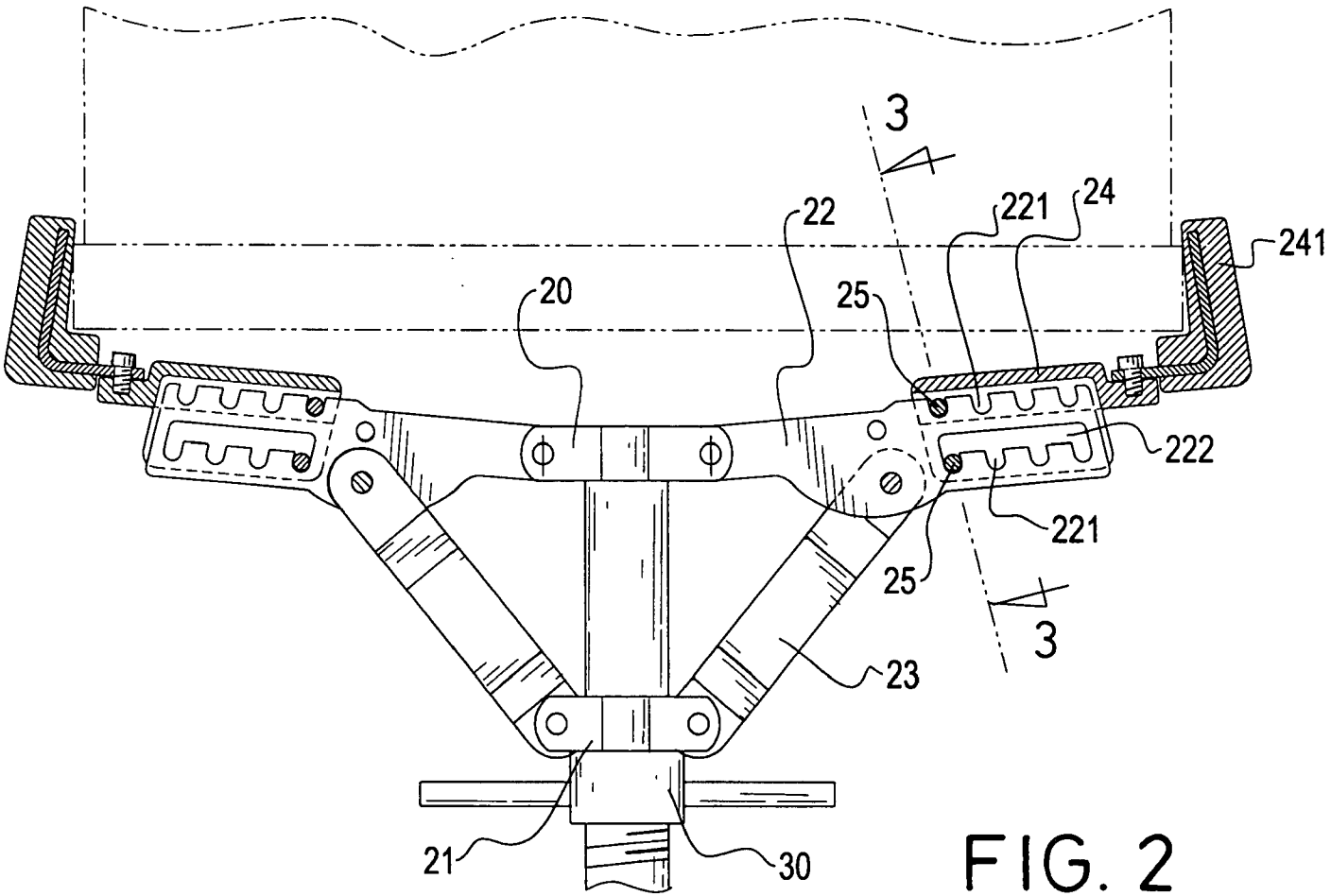
FIG. 2 is a schematic side plan view with partial in section, wherein each arm is shown to have cutouts oppositely defined in the arms.

With reference to FIG. 2, it is noted that each arm (22) has cutouts (221) defined in a top side and a mediate portion of the arm (22) and each of the claws (24) is formed to be a hollow casing to encase a corresponding one of the arms (22). The claw (24) has two pins (25) respectively extending through a top and a bottom of the claw (24) to correspond to the cutouts (221) formed on the arm (22) and a bend (241) securely formed on a free end of the claw (24).

Figure 3:
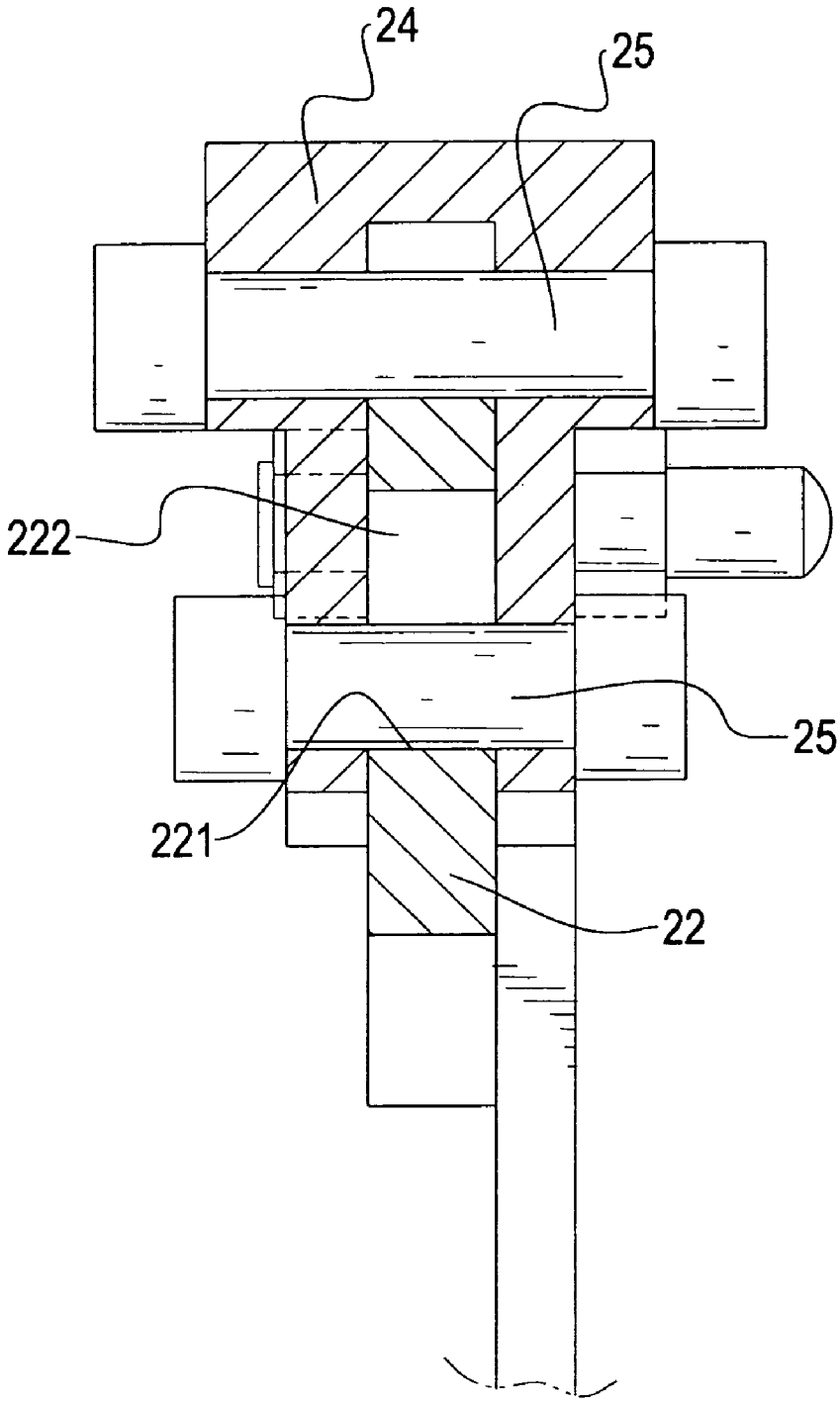
FIG. 3 is a schematic plan view showing mutual relationship between the cutout and the pin.

It is noted from FIG. 3 that after the arms (22) are encased by the claws (24), the two pins (25) of each claw (24) are respectively received in the corresponding cutouts (221).

Referring to FIG. 2, after the two pins (25) are received in the cutouts (221), a passage (222) is still left above the cutouts (221) to allow the two pins (25) to move out of the cutouts (221). Then, the operator is able to rotate the adjusting ring (30) to clamp the drum on top of the drum stand (10).

Figure 4:
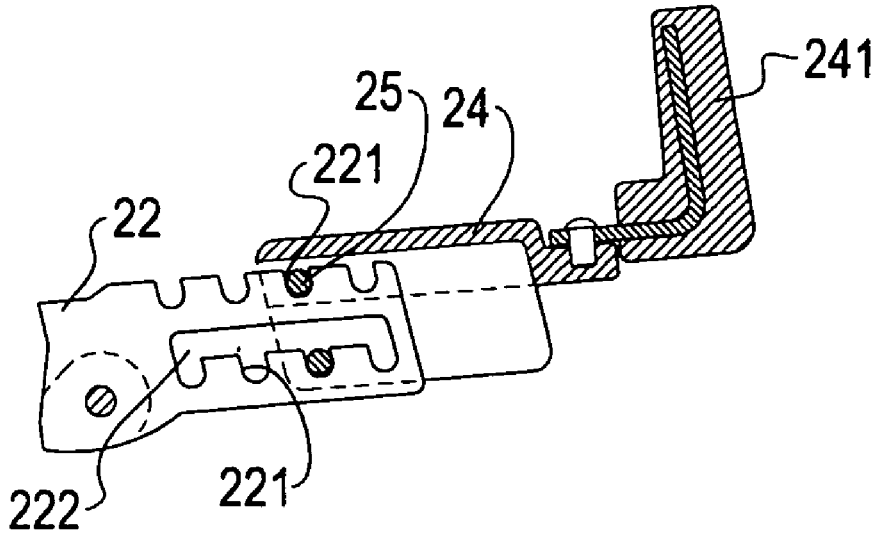
FIGS. 4 and 5 are schematic side plan views showing the adjustment of the claw relative to the arm.
Figure 5:
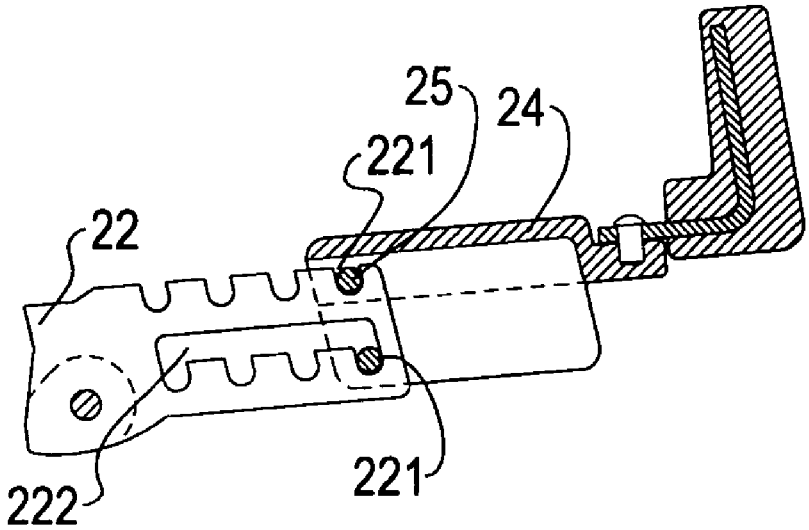

With reference to FIGS. 4 and 5, when the drum size is changed, the operator is able to lift the claw (24) to release the pins (25) from the restriction of the cutouts (221). Thus the two pins (25) are within the passages (222). At this moment, the operator is able to move the claws (24) to new locations to allow the pins (25) to be seated in the new cutouts (221) to fit the drum size.

Figure 6:
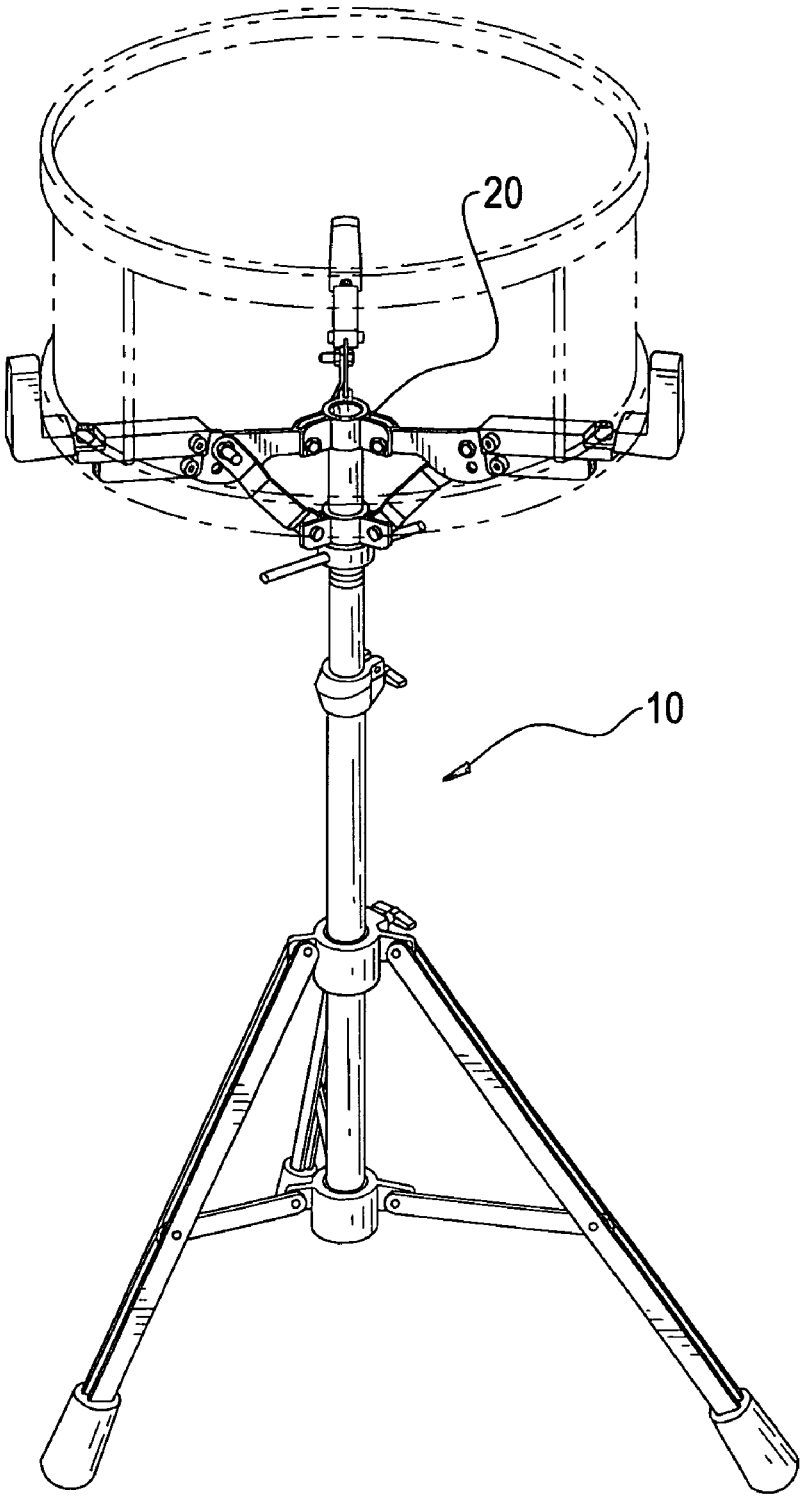
FIG. 6 is a perspective view showing the application of the retaining device of the present invention.
Figure 7:
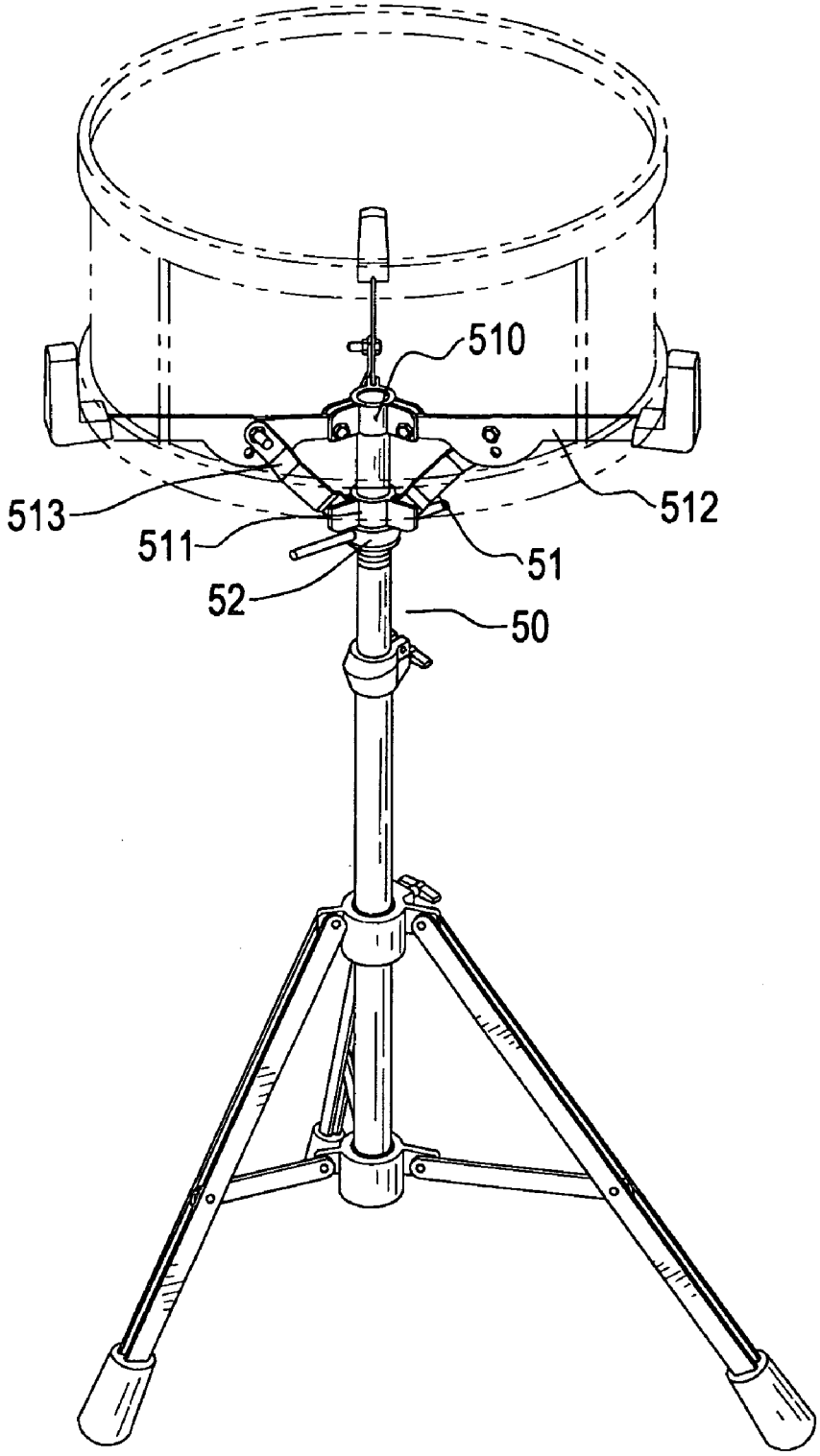
FIG. 7 PRIOR ART
FIG. 7 is a perspective view of a conventional retaining device applied to the drum.

With reference to FIG. 6, after the adjustment of the claws (24), the retaining device (20) of the present invention is able to fit drums of different dimensions without the need of a further retaining device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A retaining device for a drum stand, the retaining device comprising:

a top clamping seat adapted to be securely mounted on a distal end of the drum stand and having arms divergently extending out of the top clamping seat and each arm provided with a claw adjustably connected to the arm wherein each arm has cutouts defined in a side face of the arm and the each claw is hollow and has a pin extending through opposite sides of the claw such that the claw is able to encase therein a corresponding one of the arms and thus the pin is able to be received in a corresponding one of the cutouts;

a bottom seat adapted to be slidably mounted on the drum stand and having linkages pivotally extending upward to pivotally connect to mediate portions of the arms; and an adjusting ring adapted to be threadingly connected to the drum stand to abut a side face of the bottom seat to cause the bottom seat to move, whereby movement of the bottom seat is able to initiate movement of the top clamping seat and thus the claws are able to clamp a drum seated on the drum stand and the adjustability of the claws relative to the arms allows the retaining device to clamp drums of different sizes.

2. The retaining device as claimed in claim 1, wherein a passage is defined between the claw and the arm after the arm is encased in the claw such that the pin is able to leave restriction of the corresponding cutout and be received in different cutout of the arm so as to accomplish size adjustment of the claws.

3. The retaining device as claimed in claim 1, wherein each arm has cutouts defined in a side face and a mediate portion of the arm and each claw is hollow and has two pins extending through opposite sides of a top and a bottom of the claw such that the claw is able to encase therein a corresponding one of the arms and thus the pins are able to be received in cutouts in the top and bottom of the corresponding arm.

4. The retaining device as claimed in claim 3, wherein a passage is defined in the mediate portion of the arm to communicate with the cutouts in the mediate portion such that after the arm is encased in the claw, the pins are able to leave restriction of the corresponding cutouts and be received in different cutouts of the arm so as to accomplish size adjustment of the claws.

5. A retaining device for a drum stand, the retaining device comprising:

a top clamping seat adapted to be securely mounted on a distal end of the drum stand and having arms divergently extending out of the top clamping seat and each arm provided with a claw adjustably connected to the arm, wherein each arm has cutouts defined in a side face and a mediate portion of the arm and each claw is hollow and has two pins extending through opposite sides of a top and a bottom of the claw such that the claw is able to encase therein a corresponding one of the arms and thus the pins are able to be received in cutouts in the top and bottom of the corresponding arm;

a bottom seat adapted to be slidably mounted on the drum stand and having linkages pivotally extending upward to pivotally connect to mediate portions of the arms; and an adjusting ring adapted to be threadingly connected to the drum stand to abut a side face of the bottom seat to cause the bottom seat to move, whereby movement of the bottom seat is able to initiate movement of the top clamping seat and thus the claws are able to clamp a drum seated on the drum stand and the adjustability of the claws relative to the arms allows the retaining device to clamp drums of different sizes.

6. The retaining device as claimed in claim 5, wherein a passage is defined in the mediate portion of the arm to communicate with the cutouts in the mediate portion such that after the arm is encased in the claw, the pins are able to leave restriction of the corresponding cutouts and be received in different cutouts of the arm so as to accomplish size adjustment of the claws.

* * * * *